United States Patent [19]

Weil

[11] Patent Number: 5,062,218

[45] Date of Patent: Nov. 5, 1991

[54] SCREEN DRYER

[75] Inventor: George Weil, Mississauga, Canada

[73] Assignee: David R. Webb Co., Inc., Edinburg, Ind.

[21] Appl. No.: 593,941

[22] Filed: Oct. 9, 1990

[51] Int. Cl.[5] ..... F26B 11/02; F26B 13/00

[52] U.S. Cl. ..... 34/114; 34/116; 34/155; 34/159

[58] Field of Search ..... 34/114, 115, 116, 118, 34/122, 155, 159, 161

[56] References Cited

U.S. PATENT DOCUMENTS

| | | | |
|---|---|---|---|
| 2,671,279 | 3/1954 | Blanchard | 34/159 |
| 3,199,213 | 8/1965 | Milligan et al. | 34/155 |
| 3,280,476 | 10/1966 | Hildebrand | 34/142 |
| 3,281,134 | 10/1966 | Feiser, Jr. | 34/142 |
| 3,698,049 | 10/1972 | Fleissner | 34/115 |
| 3,896,559 | 7/1975 | Martin | 34/161 |
| 3,956,832 | 5/1976 | Justus | 34/115 |
| 4,297,794 | 11/1981 | Luthi | 34/115 |
| 4,308,667 | 1/1982 | Roos et al. | 34/155 |
| 4,417,406 | 11/1983 | Eibich | 34/155 |
| 4,442,876 | 4/1984 | Koike et al. | 34/114 |
| 4,654,981 | 4/1987 | Grebe et al. | 34/155 |
| 4,738,035 | 4/1988 | Grebe et al. | 34/155 |

*Primary Examiner*—Henry A. Bennett
*Assistant Examiner*—Denise L. F. Gromada
*Attorney, Agent, or Firm*—Barnes & Thornburg

[57] ABSTRACT

A veneer dryer has an entry end and an exit end. A conveyor conveys sheets of veneer through the dryer from the entry end to the exit end. A drying medium is applied to the veneer in the dryer. The conveyor includes a first plurality of drums, each having an axis of rotation and being rotatably mounted in the dryer and a pair of belts permeable by the drying medium. The belts run together around the drums. The sheets are captured for conveyance through the flow of drying medium in the dryer between the belts. The belts extend around a first drum, then in a direction generally from the exit end toward the entry end, then around a second drum whose axis of rotation is spaced toward the entry end from the axis of rotation of the first drum, then in a direction generally from the entry end toward the exit end, then around a third drum whose axis of rotation is spaced toward the exit end from the axis of rotation of the second drum, then in a direction generally from the exit end toward the entry end, then around a fourth drum whose axis of rotation is spaced toward the entry end from the axis of rotation of the third drum. Each drum has a generally right circular cylindrical outer circumferential surface. The axes of rotation of the first and second drums and the surfaces of the first and second drums are spaced so that the sheets of veneer are pressed against the surfaces of the first and second drums for greater than 180° of the rotation of each of the first and second drums.

13 Claims, 1 Drawing Sheet

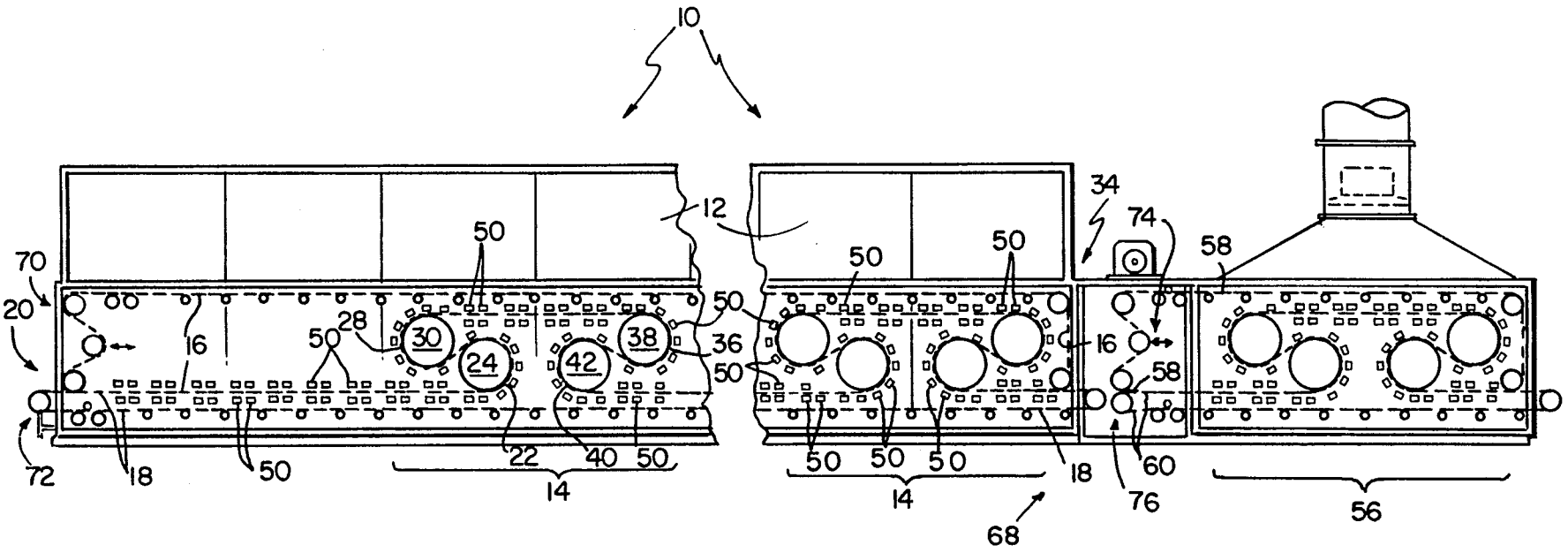
10
12
14
14
16
16
18
18
20
22
24
28
30
34
36
38
40
42
50
56
58
58
60
68
70
72
74
76

SCREEN DRYER

This invention relates to veneer dryers for drying sheets of veneer cut from flitches. Various types of veneer dryers are known. Illustrative of the many types of such dryers are the systems described in U.S. Pat. Nos.: 3,199,213; 3,280,476; 3,896,559; 4,308,667; 4,417,406; 4,442,876; 4,654,981; and, 4,738,035. Also illustrative are the systems described in Federal Republic of Germany AS 1,266,233 and OS 1,729,208. Although they relate to the drying of other materials besides veneers, attention is also directed to the systems described in the following U.S. Pat. Nos.: 2,671,279; 3,698,049; 3,956,832; 4,117,699; and 4,297,794. No representation is made or intended by this listing that an exhaustive search has been conducted for pertinent prior art or that no more pertinent prior art exists.

It has been suggested in certain of the above identified prior art, notably U.S. Pat. Nos. 4,654,981 and 4,738,035, that the passage of the veneer slices alternately over and under drums in the drying zone in a sort of zig-zag path from the entry end to the exit end between drying medium-permeable belts trained about the drums is beneficial to alleviate warping and waviness of the dried veneer. While this does appear to be the case, the applicant has found that even greater benefits are available if the pathway through the drying zone is further modified from the zig-zag pathway of the '981 and '035 patents to a pathway incorporating retrograde sections which promote pressing of the veneer slices against the dryer drums for somewhat longer lengths than are achieved with the zig-zag pattern of the '981 and '035 patents. Specifically, these retrograde sections promote pressing of the veneer slices against the dryer drums for more than 180° of the circumferences of the dryer drums.

According to one aspect of the invention, a veneer dryer has an entry end and an exit end, conveyor means for conveying sheets of veneer through the dryer from the entry end to the exit end, and means for applying a drying medium to the veneer in the dryer. The conveyor means includes a first set of drums, each having an axis of rotation and being rotatably mounted in the dryer, and a pair of belts permeable by the medium. The belts run together over the drums, with the sheets being captured for conveyance through the flow of drying medium in the dryer between the belts. The belts extend around a first set of the drums generally from the entry end toward the exit end, then generally from the exit end toward the entry end, then generally from the entry end toward the exit end, then generally from the exit end toward the entry end, and then generally from the entry end toward the exit end. The conveyor means further comprises a second set of drums. The belts extend around the second set of drums first generally from the entry end toward the exit end, then generally from the exit end toward the entry end, then generally from the entry end toward the exit end, then generally from the exit end toward the entry end, and then generally from the entry end toward the exit end.

Illustratively, the drums in each set are divided into two groups, each group comprising at least two drums. The axes of a first of said groups lie generally in a first plane and the axes of a second of said groups lie generally in a second plane above the first plane.

Additionally, the means for applying a drying medium to the veneer in the dryer illustratively comprises a source of air, the temperature and humidity of which is controlled. Flowing the temperature- and humidity-controlled air past the veneer causes the veneer to dry in a controlled fashion. The belts include portions which are readily permeable by the temperature- and humidity-controlled air.

Further, the drums comprise portions which are readily permeable by the air. The means for applying a drying medium to the veneer further comprises means for introducing the temperature- and humidity-controlled air through the air permeable portions of the drums.

According to another aspect of the invention, a veneer dryer has an entry end and an exit end, conveyor means for conveying sheets of veneer through the dryer from the entry end to the exit end, and means for applying a drying medium to the veneer in the dryer. The conveyor means includes a first plurality of drums, each having an axis of rotation and being rotatably mounted in the dryer, and a pair of belts permeable by the drying medium. The belts run together around the drums, with the sheets being captured for conveyance through the flow of drying medium in the dryer between the belts. The belts extend around a first drum, then in a direction generally from the exit end toward the entry end. The belts then extend around a second drum whose axis of rotation is spaced toward the entry end from the axis of rotation of the first drum, then in a direction generally from the entry end toward the exit end. The belts then extend around a third drum whose axis of rotation is spaced toward the exit end from the axis of rotation of the second drum, then in a direction generally from the exit end toward the entry end. Finally, the belts extend around a fourth drum whose axis of rotation is spaced toward the entry end from the axis of rotation of the third drum. Each drum has a generally right circular cylindrical outer circumferential surface. The axes of rotation of the first and second drums and the surfaces of the first and second drums are so spaced that the sheets of veneer are pressed against the surfaces of the first and second drums for greater than 180° of the rotation of each of the first and second drums.

Illustratively, the means for applying a drying medium to the veneer in the dryer comprises a source of air, the temperature and humidity of which is controlled. Flowing the temperature- and humidity-controlled air past the veneer causes the veneer to dry in a controlled fashion. The belts include portions which are readily permeable by the temperature- and humidity-controlled air.

Additionally, the drums illustratively comprise portions which are readily permeable by the air. The means for applying a drying medium to the veneer further comprises means for introducing the temperature- and humidity-controlled air through the air permeable portions of the drums.

Further, the axes of rotation of the third and fourth drums and the surfaces of the third and fourth drums illustratively are so spaced that the sheets of veneer are pressed against the surfaces of the third and fourth drums for greater than 180° of the rotation of each of the third and fourth drums.

Illustratively, the axes of rotation of the first and fourth drums lie generally in a first plane and the axes of the second and third drums lie generally in a second plane spaced from the first plane by a distance less than the sum of the radii of the first and second drums and less than the sum of the radii of the third and fourth drums.

Illustratively, the radii of the first, second, third and fourth drums are all substantially the same.

Additionally, the apparatus illustratively further Comprises a second plurality of drums configured substantially identically to the first plurality of drums.

The invention may best be understood by referring to the following detailed description of an illustrative embodiment and the drawing which illustrates the invention.

The drawing is a fragmentary longitudinal sectional side elevational view of a veneer dryer constructed according to the invention.

The veneer dryer 10 of the drawing comprises a generally closed drying chamber 12 made up of a number of sections 14, only two of which are illustrated for ease of understanding. A pair of screen conveyor belts 16, 18 extend entirely through all of the sections 14. Belts 16, 18 convey between their facing surfaces sheets of veneer which have been cut from flitches. The flitches have been prepared for cutting by processes that typically include steeping the flitches for periods of time in vats of hot water. This processing, along with the moisture already existing in the wood of the flitches, guarantees a substantial moisture content to the sliced veneer. It is common practice in the veneer industry to dry the veneer down to a lower, acceptable moisture content, and this is the aim of the dryer 10.

The sliced sheets of veneer are laid crosswise (grain extending into and out of the plane of the drawing) across lower belt 18 at the entry end 20 of the dryer 10. As belt 18 is driven under the control of a prime mover (not shown), the sheets of veneer to be dried are carried into dryer 10 and under the under surface of upper belt 16. The sheets of veneer are conveyed between the facing surfaces of belts 16, 18 under and then over the outer, generally right circular cylindrical surface 22 of a first drum 24 in a retrograde direction, that is, back toward the entry end 20 of dryer 10. During the contact of belt 16 with drum 24, the sheets of veneer are pressed against the circumference of drum 24, with belt 16 between the veneer and surface 22, for approximately 225° of the 360° circumference of drum 24. As the retrograde motion of the veneer sheets nears its end, belt 18 encounters the outer, generally right cylindrical surface 28 of a second drum 30. During the contact of belt 18 with drum 30, the sheets of veneer are pressed against the circumference of drum 30, with belt 18 between the veneer and surface 28, for approximately 225° of the 360° circumference of drum 30. As the belts 16, 18 with the sheets of veneer captured therebetween exit over the top of drum 30, they are once again moving in the forward direction through veneer dryer 10, that is, away from entry end 20 and toward exit end 34 of dryer 10.

The belts 16, 18 with the sheets of veneer captured therebetween are next conveyed over outer, generally right circular cylindrical surface 36 of a third drum 38. During the contact of belt 16 with drum 38, the sheets of veneer are pressed against the circumference of drum 38, with belt 16 between the veneer and surface 36, for approximately 225° of the 360° circumference of drum 38. As the sheets of veneer are conveyed under drum 38, they once again experience retrograde motion. As this retrograde motion nears its end, belt 18 encounters the outer, generally right circular cylindrical surface 40 of a fourth drum 42. During the contact of belt 18 with drum 42, the sheets of veneer are pressed against the circumference of drum 42, with belt 18 between the veneer and surface 40, for approximately 225° of the 360° circumference of drum 42. As the belts 16, 18 with the sheets of veneer captured therebetween exit under the bottom of drum 42, they are once again moving in the forward direction through veneer dryer 10, that is, away from entry end 20 and toward exit end 34 of dryer 10. Illustratively, the radii of all of drums 24, 30, 38 and 42 are approximately 15 inches (38.1 cm). The vertical spacing between the rotational axis of drum 24 and that of drum 30, and between the rotational axis of drum 38 and that of drum 42, is about 14 inches (35.6 cm). The horizontal spacing between the rotational axis of drum 24 and that of drum 30, and between the rotational axis of drum 38 and that of drum 42, is about 38 inches (96.5 cm).

Jet drying boxes 50 of known construction are provided adjacent the surfaces of belts 16, 18 substantially along the entire length of the region where they lie adjacent each other. As previously noted, belts 16, 18 are constructed from screen or other material readily permeable by temperature- and humidity-controlled air which is dispensed from nozzle or jet outlets, not shown, provided from jet boxes 50 onto and through the belts 16, 18 to dry the strips of veneer being conveyed therebetween. Additional jet boxes 50 surround the outer, generally, right circular cylindrical surfaces 22, 28, 36 and 40 of drums 24, 30, 38 and 42, respectively. In addition, temperature- and humidity-controlled air can be provided by any of a number of known means to the interiors of drums 24, 30, 38 and 42. This temperature- and humidity-controlled air can be provided from these interiors to surfaces 22, 28, 36 and 40, for example, by making drums 24, 30, 38 and 42 from perforated materials Such construction provides temperature- and humidity-controlled air to the surfaces of the sheets of veneer as they lie against surfaces 22, 28, 36 and 40.

Although only one other section 14 is illustrated in the drawing, it is understood that any number of sections 14 can be provided to achieve any desired degree of drying of the veneer sheets being processed. The horizontal spacings between the axes of rotation of the adjacent drums 24, 30, 30, 38 and 38, 42 can be of any desired length as well, although it should be understood that as the horizontal spacings between the axes of drums 24 and 30 and between drums 38 and 42 increase, the dwell angles of the sheets of veneer on surfaces 22 and 28 and on surfaces 36 and 40 decrease toward 180°. On the other hand, as noted in the '981 and '035 patents, there does appear to be some benefit to permitting the sheets to be conveyed for some short distance in the drying zone out of contact with the drum surfaces.

Immediately downstream from the exit end 34 of the dryer 10 is a cooling chamber 56 having a pair of screen belts 58, 60 between which sheets of veneer are conveyed after they exit dryer 10 for controlled cooling back toward ambient temperature. Cooling chamber 56 is constructed in generally the same manner as each section 14, with a set of four drums around which its screen belts are trained, and jet boxes which provide temperature- and humidity-controlled air from a source separate from sections 14 to effect cooling of the dried veneer sheets back toward ambient temperature. Belt tensioners 70, 72, 74 and 76 of known configurations are provided at the entry ends 20, 68 of dryer 10 and cooling chamber 56 for belts 16, 18, 58 and 60.

What is claimed is:

1. A veneer dryer having an entry end and an exit end conveyor means for conveying sheets of veneer through the dryer from the entry end to the exit end, and means for applying a drying medium to the veneer in the dryer, the conveyor means including a first set of drums, each having an axis of rotation and being rotatably mounted in the dryer, a pair of belts permeable by the medium, the belts running together over the drums, the sheets being captured for conveyance through the flow of drying medium in the dryer between the belts, the belts extending around a first set of said drums generally from the entry end toward the exit end, then generally from the exit end toward the entry end, then generally from the entry end toward the exit end, then generally from the exit end toward the entry end, and then generally from the entry end toward the exit end, and further comprising a second set of said drums, the belts extending around said second set of drums first generally from the entry end toward the exit end, then generally from the exit end toward the entry end, then generally from the entry end toward the exit end, then generally from the exit end toward the entry end, and then generally from the entry end toward the exit end the axes of rotation of the first and second sets of drums and the surfaces of the first and second sets of drums being so spaced that the sheets of veneer are pressed against the surfaces of the first and second sets of drums for greater than 180° of the rotation of each of the first and second sets of drums.

2. The apparatus of claim 1 wherein the drums in each set are divided into two groups, each group comprising at least two drums, the axes of a first of said groups lying generally in a first plane and the axes of a second of said groups lying generally in a second plane lying above the first plane.

3. The apparatus of claim 1 or 2 wherein the means for applying a drying medium to the veneer in the dryer comprises a source of air, the temperature and humidity of which is controlled, flowing the temperature- and humidity-controlled air past the veneer causing the veneer to dry in a controlled fashion, the belts including portions which are readily permeable by the temperature- and humidity-controlled air.

4. The apparatus of claim 3 Where in the drums comprise portions which are readily permeable by the air and the means for applying a drying medium to the veneer further comprises means for introducing the temperature- and humidity-controlled air through the air permeable portions of the drums.

5. A veneer dryer having an entry end and an exit end, conveyor means for conveying sheets of veneer through the dryer from the entry end to the exit end, and means for applying a drying medium to the veneer in the dryer, the conveyor means including a first plurality of drums, each having an axis of rotation and being rotatably mounted in the dryer, a pair of belts permeable by the drying medium, the belts running together around the drums, the sheets being captured for conveyance through the flow of drying medium in the dryer between the belts, the belts extending around a first drum, then in a direction generally from the exit end toward the entry end, then around a second drum whose axis of rotation is spaced toward the entry end from the axis of rotation of the first drum, then in a direction generally from the entry end toward the exit end, then around a third drum whose axis of rotation is spaced toward the exit end from the axis of rotation of the second drum, then in a direction generally from the exit end toward the entry end, then around a fourth drum whose axis of rotation is spaced toward the entry end from the axis of rotation of the third drum, each drum having a generally right circular cylindrical outer circumferential surface, the axes of rotation of the first and second drums and the surfaces of the first and second drums being so spaced that the sheets of veneer are pressed against the surfaces of the first and second drums for greater than 180° of the rotation of each of the first and second drums.

6. The apparatus of claim 5 wherein the means for applying a drying medium to the veneer in the dryer comprises a source of air, the temperature and humidity of which is controlled, flowing the temperature- and humidity-controlled air past the veneer causing the veneer to dry in a controlled fashion, the belts including portions which are readily permeable by the temperature- and humidity-controlled air.

7. The apparatus of claim 6 wherein the drums comprise portions which are readily permeable by the air and the means for applying a drying medium to the veneer further comprises means for introducing the temperature- and humidity-controlled air through the air permeable portions of the drums.

8. The apparatus of claim 5 wherein the axes of rotation of the third and fourth drums and the surfaces of the third and fourth drums are so spaced that the sheets of veneer are pressed against the surfaces of the third and fourth drums for greater than 180° of the rotation of each of the third and fourth drums.

9. The apparatus of any of claims 5 through 8 wherein the axes of rotation of the first and fourth drums lie generally in a first plane and the axes of the second and third drums lie generally in a second plane spaced from the first plane by a distance less than the sum of the radii of the first and second drums and less than the sum of the radii of the third and fourth drums.

10. The apparatus of claim 9 wherein the radii of the first, second, third and fourth drums are all substantially the same.

11. The apparatus of any of claims 5 through 8 and further comprising a second plurality of drums configured substantially identically to the first plurality of drums.

12. The apparatus of claim 9 and further comprising a second plurality of drums configured substantially identically to the first plurality of drums.

13. The apparatus of claim 10 and further comprising a second plurality of drums configured substantially identically to the first plurality of drums.

* * * * *